United States Patent [19]

Mishina et al.

[11] 4,105,372

[45] Aug. 8, 1978

[54] FLUID ROTARY MACHINE

[75] Inventors: Haruo Mishina, Inashiki; Kazuhiro Sunobe, Urawa; Kunio Fujie, Tokyo, all of Japan

[73] Assignee: Hitachi, Ltd., Japan

[21] Appl. No.: 650,765

[22] Filed: Jan. 20, 1976

[30] Foreign Application Priority Data

Jan. 31, 1975 [JP] Japan ..... 50-12571

[51] Int. Cl.[2] ..... F01D 1/24; F01D 13/00

[52] U.S. Cl. ..... 417/243; 417/244; 417/350; 415/66; 74/421 A; 417/374; 417/423 R; 415/122 R

[58] Field of Search ..... 417/243, 244, 350, 423, 417/405; 415/60, 64, 122 R, 66, 68; 74/421 A; 60/39.16 S, 39.75

[56] References Cited

U.S. PATENT DOCUMENTS

| | | | |
|---|---|---|---|
| 3,038,307 | 6/1962 | Oprecht | 415/60 |
| 3,330,476 | 7/1967 | Bruyere | 415/122 |
| 3,361,072 | 1/1968 | Tungate et al. | 415/122 |
| 3,976,390 | 8/1976 | Silvern et al. | 415/122 |

FOREIGN PATENT DOCUMENTS

| | | | |
|---|---|---|---|
| 773,827 | 5/1957 | United Kingdom | 417/350 |

*Primary Examiner*—Carlton R. Croyle
*Assistant Examiner*—R. E. Gluck
*Attorney, Agent, or Firm*—Craig & Antonelli

[57] ABSTRACT

According to the present invention, fluid rotary machines including a turbo-compressor, turbo-desiccator, turbo-refrigerator, turbo-generator and the like are of such an arrangement that supporting shafts corresponding to impellers in number and a gear train changing R.P.M. of said supporting shafts to the optimum R.P.M. of the impellers mounted on said supporting shafts are provided, so that the respective impellers can operate at the optimum R.P.M. individually.

21 Claims, 11 Drawing Figures

FLUID ROTARY MACHINE

This invention relates to fluid rotary machines including a turbo-compressor, turbo-desiccator, turbo-refrigerator, turbo-generator and the like.

There has been a single-shaft multi-stage type compressor as a fluid rotary machine of the type related to this invention. Said single-shaft multi-stage type compressor has a supporting drive shaft on which a plurality of impellers are mounted in tandem.

Description will hereunder be given on a two-stage version of the single-shaft multi-stage compressor with reference to FIG. 1.

FIG. 1 is a cross-sectional view of the portions of the single-shaft two-stage compressor except for the drive electric-motor, which can be broadly divided into three sections including a drive electro-motor 1, transmission means 2, and a compressor 3.

The drive electric-motor 1 is substantially same in construction as that sold on the market, so that description thereof is omitted. The transmission means 2 comprises: a casing 4; a drive shaft 6 rotatably supported by said casing 4 through four bearings 5; a subsidiary shaft 7; a gear 8 solidly secured to the drive shaft 6; and a pinion 9 being affixed on the subsidiary shaft 7 and meshing with said gear 8.

The compressor 3 comprises: a casing 10; a rotary shaft 12 which may be called an extension of one end of the subsidiary shaft 7 of the transmission means 2, extends through the central portion of the casing 10 and is rotatably supported at the left-hand end thereof by the casing 10 through a bearing 11; a first impeller 13 couplingly secured to said rotary shaft 12; a second impeller 14; a reverse flow passage 16 introducing the gas discharged from the first impeller 13 to the second impeller 14; and a discharge passage 17 of the second impeller 14.

An output shaft of said drive electric-motor 1 and the drive shaft 6 of the transmission means 2 are connected to each other by means of a coupling 18.

As described above, the single-shaft multi-stage compressor is provided with the supporting drive shaft fitted thereon with a plurality of impellers and hence it has such features that construction of the casing 10 can be simplified and installation area can be made small. However, on the other hand, R.P.M. for driving all of the impellers is equal and it has been difficult that the respective impellers are each driven at R.P.M. where the highest efficiencies of the respective impellers can be attained in operation or at R.P.M. where the operating ranges of the respective impellers can be largest, i.e., at the optimum R.P.M. of the respective impellers, and hence it has been unavoidable that the over-all efficiency becomes low and the ranges of operation are narrow.

An object of the present invention is to provide a fluid rotary machine in which the respective impellers can be each operated at the optimum R.P.M. Another object of the present invention is to provide a fluid rotary machine in which construction of the housing is simplified and installation area is small.

BRIEF DESCRIPTION OF THE DRAWINGS

FIGS. 2 through 11 are cross-sectional views illustrating various embodiments of the present invention, in which FIG. 2 is a cross-sectional view of the embodiment wherein this invention is applied to a two-stage compressor, FIG. 3 a cross-sectional view of the embodiment wherein the type of transmission means 2 other than that shown in FIG. 2 is used, FIG. 4 a cross-sectional view as viewed in the direction of IV—IV, FIG. 5 is a cross-sectional view of the embodiment wherein each one impeller is disposed at one side of the drive electric-motor and of the transmission means, respectively, FIG. 6 a cross-sectional view of the embodiment wherein this invention is applied to a compressor having three impellers, FIG. 7 a cross-sectional view of the embodiment wherein a compressor with one impeller and a compressor with two impellers are disposed at one side of the drive electric-motor and of the transmission means, respectively, FIG. 8 a cross-sectional view of the embodiment wherein one compressor with two impellers is disposed at one side of the drive electric-motor and of the transmission means, respectively, FIG. 9 a cross-sectional view of the embodiment wherein the transmission means shown in FIG. 8 is disposed at both sides of the drive electric motor, FIG. 10 a cross-sectional view of the embodiment wherein this invention is applied to a turbo-generator set, and FIG. 11 a cross-sectional view of the embodiment wherein this invention is applied to a turbo-desiccator.

DETAILED DESCRIPTION OF THE DRAWINGS

Figure 2:
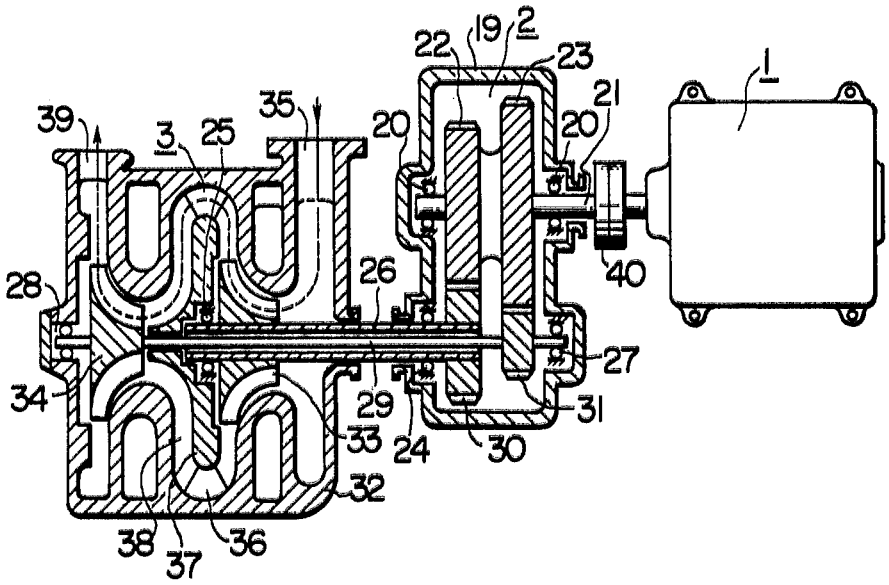

FIG. 2 represents a cross-sectional view of the embodiment in which the present invention is applied to a two-stage type turbo-gas compressor.

The transmission means 2 comprises: a casing 19; a drive shaft 21 rotatably supported by said casing 19 through a bearing 20 and coupled to the drive electric-motor 1 by means of a coupling 40; two gears 22, 23 couplingly secured to said drive shaft 21 and varied with each other in number of teeth; a hollow rotary shaft 26 being rotatably supported at one end by the casing 19 through a bearing 24 and at the other end by a stage plate 37 of the compressor 3, which will be described hereinafter, through a bearing 25; a rotary shaft 29 being rotatably supported at one end by the casing 19 through a bearing 27, at the other end by a casing 32 of the compressor 3, which will be described hereinafter, through a bearing 28 and extending through the interior of said hollow rotary shaft 26; a pinion 30 couplingly secured to the right-hand end portion of said hollow rotary shaft 26 and meshing with said gear 22; and a pinion 31 couplingly secured to said rotary shaft 29 and meshing with said gear 23.

The compressor 3 comprises: a casing 32; a first impeller 33 couplingly secured to the hollow rotary shaft 26 of said transmission means 2 which is extending through the central portion of said casing 32 and a second impeller 34 couplingly secured to the rotary shaft 29; an intake passage 35 of the first impeller 33, which is defined by the casing 32; a stage plate 37 disposed between the first impeller 33 and the second impeller 34 and mounted on the casing 32 through a support 36; a reverse flow passage 38 defined by the casing 32 and the stage plate 37 and introducing the gas discharged from the first impeller 33 into the second impeller 34; and a discharge passage 39 of the second impeller 34, which is defined by the casing 32.

On condition that R.P.M. of the drive electric-motor 1 is constant, R.P.M. for driving the aforesaid first impeller 33 is determined by the gear ratio between the gear 22 and the pinion 30, and R.P.M. for driving the second impeller 34 by the gear ratio between the gear 23 and the pinion 31. Those gear ratios are selected so that the resulting R.P.M. can bring about the highest efficiencies or the widest ranges of operation of the respective impellers.

The drive electric-motor has construction similar to the prior art one, so that description thereof is omitted.

Next, operation of said embodiment will be described.

When the drive electric-motor 1 is energized, the rotation is transmitted to the drive shaft 21 of the transmission means 2 by way of the coupling 40. The rotation of the drive shaft 21 is transmitted to the hollow rotary shaft 26 by way of the gear 22 and the pinion 30 meshing therewith to drive the first impeller 33. On one hand, the rotation of the drive shaft 21 is transmitted to the second impeller 34 by way of the gear 23 and the pinion 31 meshing therewith to drive the second impeller 34. The rotations of both impellers 33, 34 cause gas to pass the intake passage 35 and be sucked into the first impeller 33, where it is compressed. The gas thus compressed is discharged, passes through the reverse flow passage 38, is sucked into the second impeller 34, where it is further compressed, and discharged through the discharge passage 39.

Figure 3:
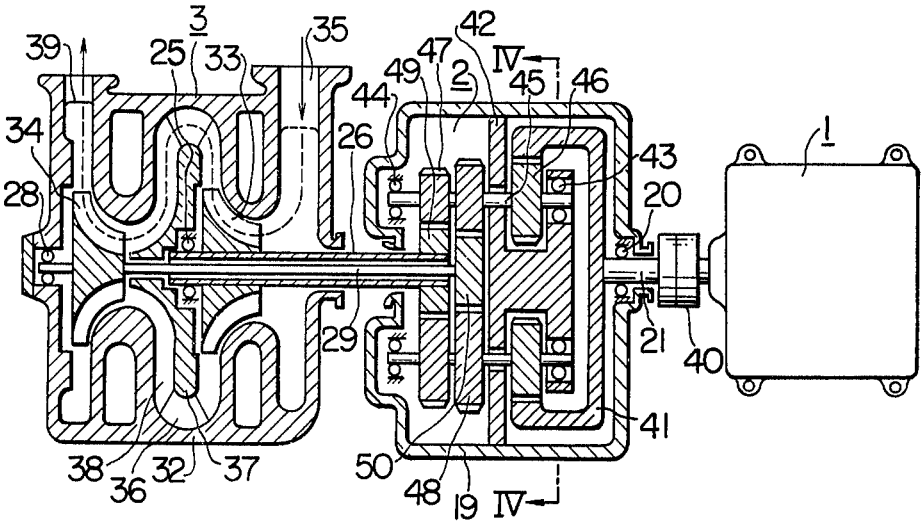
Figure 4:
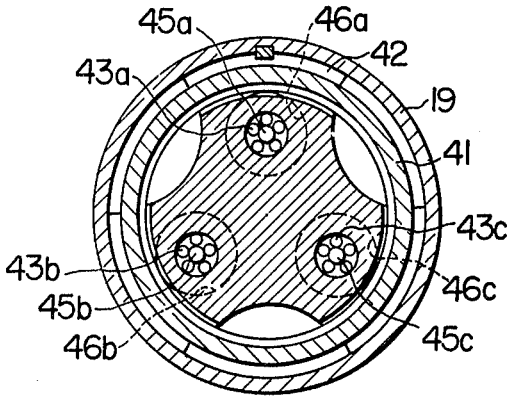

FIGS. 3 and 4 show the embodiment in which the type of transmission means 2 other than that shown in FIG. 2 is used. FIG. 3 is a cross-sectional view thereof and FIG. 4 a cross-sectional view taken along the line IV—IV of FIG. 3.

The transmission means 2 in this embodiment comprises: a casing 19; a drive shaft 21 rotatably supported by the casing 19 through a bearing 20 and connected to a drive electric-motor 1 by means of a coupling 40; an internal gear 41 secured to said drive shaft 21; a support 42 disposed within the casing 19 and detachably secured to the casing 19; shafts 45 (45*a*, 45*b* and 45*c*) supported at one ends thereof by said support 42 through bearings 43 (43*a*, 43*b* and 43*c*), at the other ends by the casing 19 through bearings 44, and arranged at equal angular intervals; pinions 46 (46*a*, 46*b* and 46*c*) meshing with said internal gear 41 and couplingly secured to said shafts 45, respectively, and a set of two gears 47 (47*a*, 47*b* and 47*c*) and 48 (48*a*, 48*b* and 48*c*)couplingly secured to said shafts 45, respectively; a hollow rotary shaft 26 supported at the other end by a stage plate 37 of the compressor 3 through a bearing 25; a rotary shaft 29 supported at the other end by the casing 32 of the compressor 3 through a bearing 28 and extending through the interior of the hollow rotary shaft 26; a first sun gear 49 couplingly secured to one end of the hollow rotary shaft 26 and meshing with the aforesaid three gears 47 (47*a*, 47*b* and 47*c*); and a second sun gear 50 couplingly secured to one end of the rotary shaft 29 and meshing with the aforesaid three gears 48 (48*a*, 48*b* and 48*c*).

Figure 1:
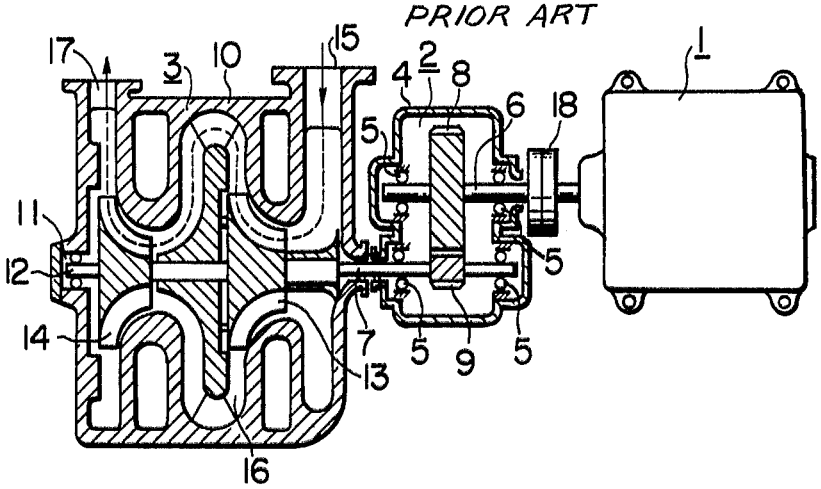
FIG. 1 PRIOR ART
FIG. 1 is a cross-sectional view showing a single-shaft two-stage type turbo-gas compressor of the prior art.

One end of the hollow rotary shaft 26 is being held in its position by the first sun gear 49 and the three gears 47 (47*a*, 47*b* and 47*c*) arranged at the angular intervals of 120°, surrounding said sun gear 49. Likewise, one end of the rotary shaft 29 is being held in its position by the second sun gear 50 and the three gears 48 (48*a*, 48*b* and 48*c*) arranged at the angular intervals of 120°, surrounding said sun gear 50. The rotation of the drive electric-motor 1 which is transmitted to the drive shaft 21 by way of the coupling 40, is transmitted to the shafts 45 (45*a*, 45*b* and 45*c*) by way of the internal gear 41 and the pinions 46 (46*a*, 46*b* and 46*c*) meshing therewith. The rotation of the drive shafts 45 (45*a*, 45*b* and 45*c*) is transmitted to the hollow rotary shaft 26 by way of the gears 47 (47*a*, 47*b* and 47*c*) and the first sun gear 49 meshing therewith to drive the first impeller 33. Additionally, the rotation of the shafts 45 (45*a*, 45*b* and 45*c*) is transmitted to the rotary shaft 29 by way of the gears 48 (48*a*, 48*b* and 48*c*) and the second sun gear 50 meshing therewith to rotate the second impeller 34. Others are similar to that shown in FIG. 1, so that description thereof is omitted.

Figure 5:
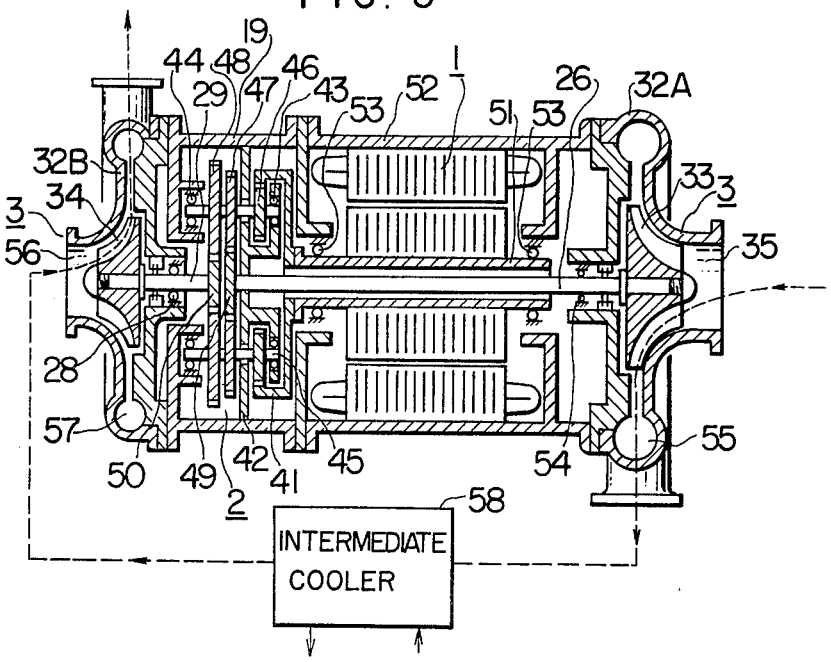

FIG. 5 shows the embodiment in which each one impeller of the compressor 3 is disposed at one side of the drive electric-motor 1 and the transmission means 2.

This drive electric means 1 is similar to the embodiment shown in FIGS. 3 and 4 in construction except that a shaft 51 supported by a housing 52 through a bearing 53 is made of hollow construction, so that description thereof is omitted.

The transmission means 2 is of such arrangement that a casing 19 is mounted at the left-hand end of the housing 52 of the drive electric-motor 1, the drive shaft 21 in the embodiment shown in FIGS. 3 and 4 is eliminated, the internal gear 41, which was formerly couplingly secured to said drive shaft 21 is couplingly secured to the hollow shaft 51 of the drive electric-motor 1, directly. The hollow rotary shaft 26, to which the first sun gear 49 is solidly secured, is replaced by a solid shaft (This new shaft is hereunder referred to as "a shaft" and represented by the same reference numeral 26 is heretofore.), and supported at the right-hand end thereof by a casing 32A of the compressor 3, which will be described hereinafter, through a bearing 54. On the other hand, the rotary shaft 29, to which the second sun gear 50 is couplingly secured, is supported by a casing 32B of the compressor 3, which will be described hereinafter, through a bearing 28. Others are similar to the embodiment shown in FIGS. 3 and 4, so that same reference numerals as shown in those drawings are used to designate same or similar parts and description thereof is omitted.

The compressor 3 is divided into two sections disposed at the right side and the left side. Disposed at the right side is the first stage of the compressor comprising: the casing 32A mounted on the right end face of the housing; the first impeller 33 disposed within the casing 32A and couplingly secured to the shaft 26; an intake passage defined by the casing 32A; and a spiral discharge passage 55. Disposed at the left side is the second stage of the compressor which is of an arrangement similar to the first stage and comprises: the casing 32B mounted on the left end face of the casing 19 of the transmission means 2; the second impeller 34 disposed within the casing 32B and couplingly secured to the rotary shaft 29; an intake passage 56 defined by the casing 32B; and a spiral discharge passage 57.

An intermediate cooler 58 cooling the compressed gas flowing from the first stage compressor to the second stage compressor is disposed between said discharge passage 55 of the first stage compressor and the intake passage 56 of the second stage compressor.

Next, operation of said embodiment will be described.

When the drive electric-motor 1 is energized, the rotation thereof is transmitted to the shafts 45 (45*a*, 45*b* and 45*c*) by way of the hollow shaft 51, the internal gear 41 solidly secured to said hollow shaft 51 and the three pinions 46 (46*a*, 46*b* and 46*c*) meshing with the internal gear 41. Further, the rotation of the shafts 45 (45*a*, 45*b* and 45*c*) is transmitted to the shaft 26 by way of the gears 47 (47*a*, 47*b* and 47*c*) and the first sun gear 49 to rotate the first impeller 33. Additionally, the rotation of the shafts 45 (45*a*, 45*b* and 45*c*) is transmitted to the rotary shaft 29 by way of the gears 48 (48*a*, 48*b* and 48*c*) and the second sun gear 50 meshing therewith to rotate the second impeller 34. The rotations of both impellers 33, 34 cause gas to be sucked in through the intake passage 35, compressed and discharged through the discharge passage 55. The gas thus discharged passes through the intermediate cooler 58 where it is cooled by undergoing heat exchange with water, then passes the intake passage 56, is sucked into the second impeller 34, where it is further compressed, and discharged through the discharge passage 57.

Figure 6:
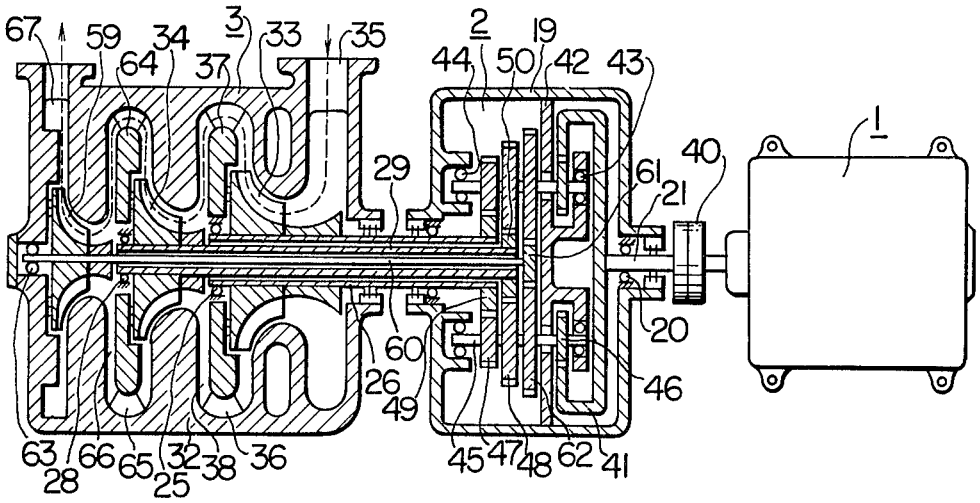

FIG. 6 shows the embodiment in which the present invention is applied to a compressor having three impellers.

Said embodiment is of an arrangement substantially same as that of the embodiment shown in FIGS. 3 and 4 except that, with an additional provision of a third impeller 59 to the compressor 3, there are newly provided a rotary shaft 60 supporting and rotating the third impeller 59, a third sun gear 61 solidly secured to said rotary shaft 60, and gears 62 (62*a*, 62*b* and 62*c*) meshing with said gear 61 and coupling secured to the shafts 45 (45*a*, 45*b* and 45*c*).

Referring to the drawing, 63 is a bearing rotatably supporting the left end portion of the rotary shaft 60, 64 a second stage plate mounted on the casing 32 of the compressor 3 through a support 65, 66 a second reverse flow passage, and 67 a discharge passage.

Figure 7:
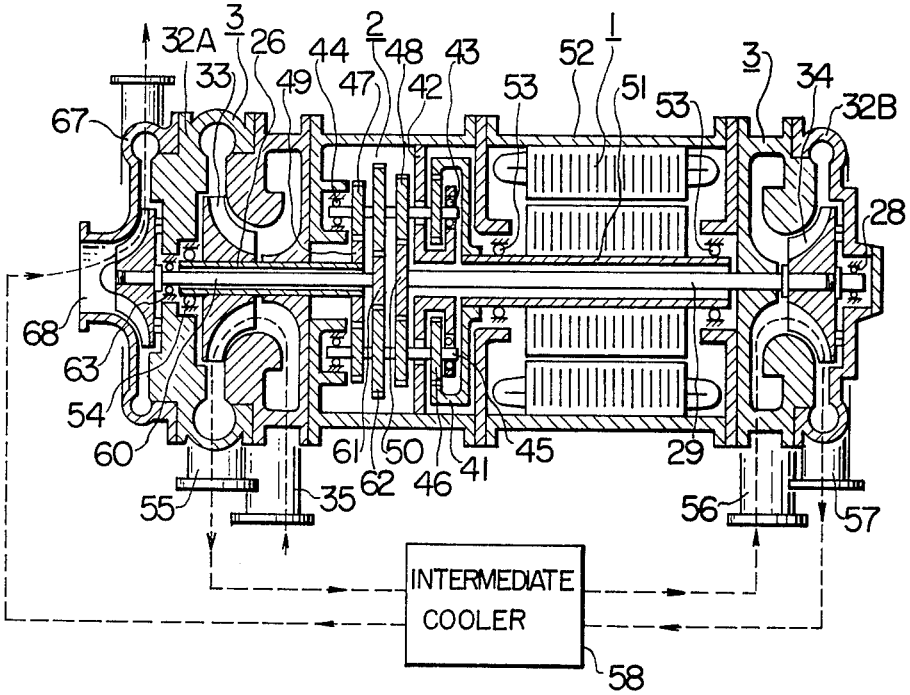

FIG. 7 shows the embodiment in which a compressor with one impeller and a compressor with two impellers are disposed at the side of the drive electric-motor 1 and of the transmission means 2, respectively.

Said embodiment is of an arrangement similar to that of the embodiment shown in FIG. 5 above except that there are newly provided that third impeller 59, the rotary shaft 60 supporting and rotating the third impeller 59, the third sun gear 61 couplingly secured to said rotary shaft 60, and three gears 62 (62*a*, 62*b* and 62*c*) meshing with said sun gear 61 and couplingly secured to the shafts 45 (45*a*, 45*b* and 45*c*). The rotation of the drive electric-motor 1, which is transmitted to the shafts 45 (45*a*, 45*b* and 45*c*) by way of the pinions 46 (46*a*, 46*b* and 46*c*), is in turn transmitted to the rotary shaft 60 to rotate the third impeller 59 by way of the gears 62 (62*a*, 62*b* and 62*c*) and the third sun gear 61.

The route, through which the rotating power for rotating the first and second impellers 33, 34 is transmitted, is same as in the embodiment shown in FIG. 5 above, so that description thereof is omitted.

The rotations of the first, second and third impellers 33, 34 and 59 cause gas to be sucked through the intake passage 35 into the first impeller 33, compressed and discharged through the discharge passage 55. The compressed gas from the discharge passage 55 passage through the intermediate cooler 58 where it is cooled, then is sucked through the intake passage 56 into the second impeller 34, compressed, and discharged through the discharge passage 57. The compressed gas from the discharge passage 57 passes through the intermediate cooler 58 where it is cooled, then is sucked through the intake passage 68 into the third impeller 59, compressed, and discharged through the discharge passage 67.

Figure 8:
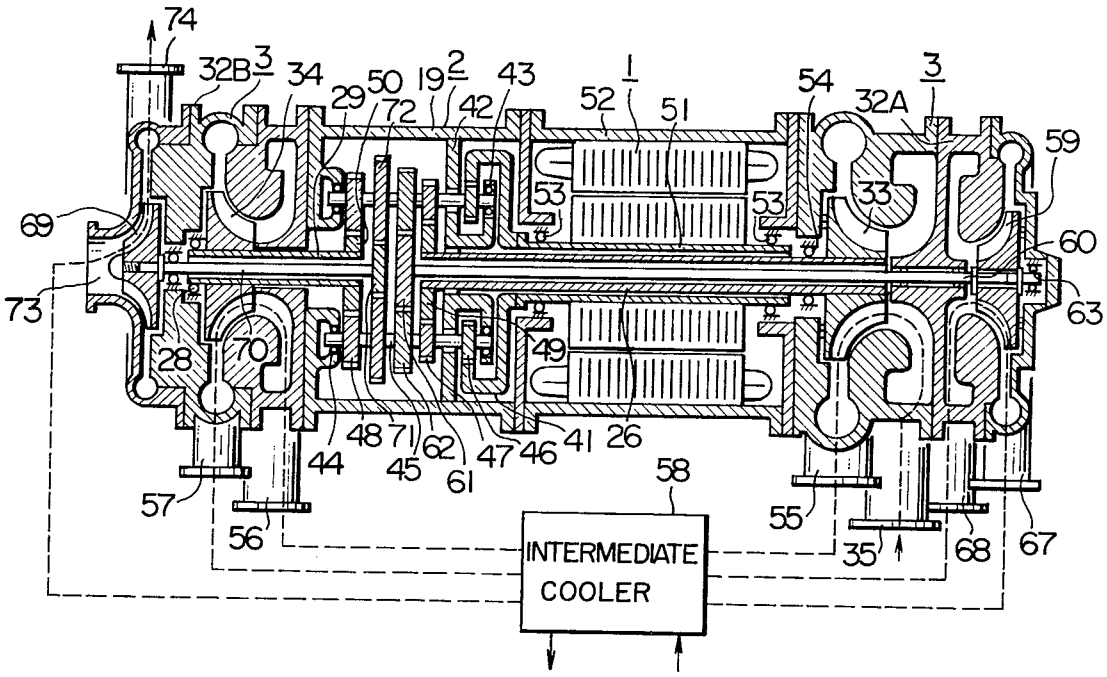

FIG. 8 shows the embodiment in which the present invention is applied to a compressor with four impellers.

Said embodiment is of an arrangement similar to that of the embodiment shown in FIG. 7 except that there are newly provided a fourth impeller 69, a rotary shaft 70 supporting and rotating said impeller 69, a fourth sun gear 71 couplingly secured to the right end portion of said rotary shaft 70, and three gears 72 meshing with said sun gear 71 and couplingly secured to the aforesaid shafts 45 (45*a*, 45*b* and 45*c*).

Referring to the drawing, 73 is an intake passage of the fourth impeller 69, and 74 a discharge passage.

Figure 9:
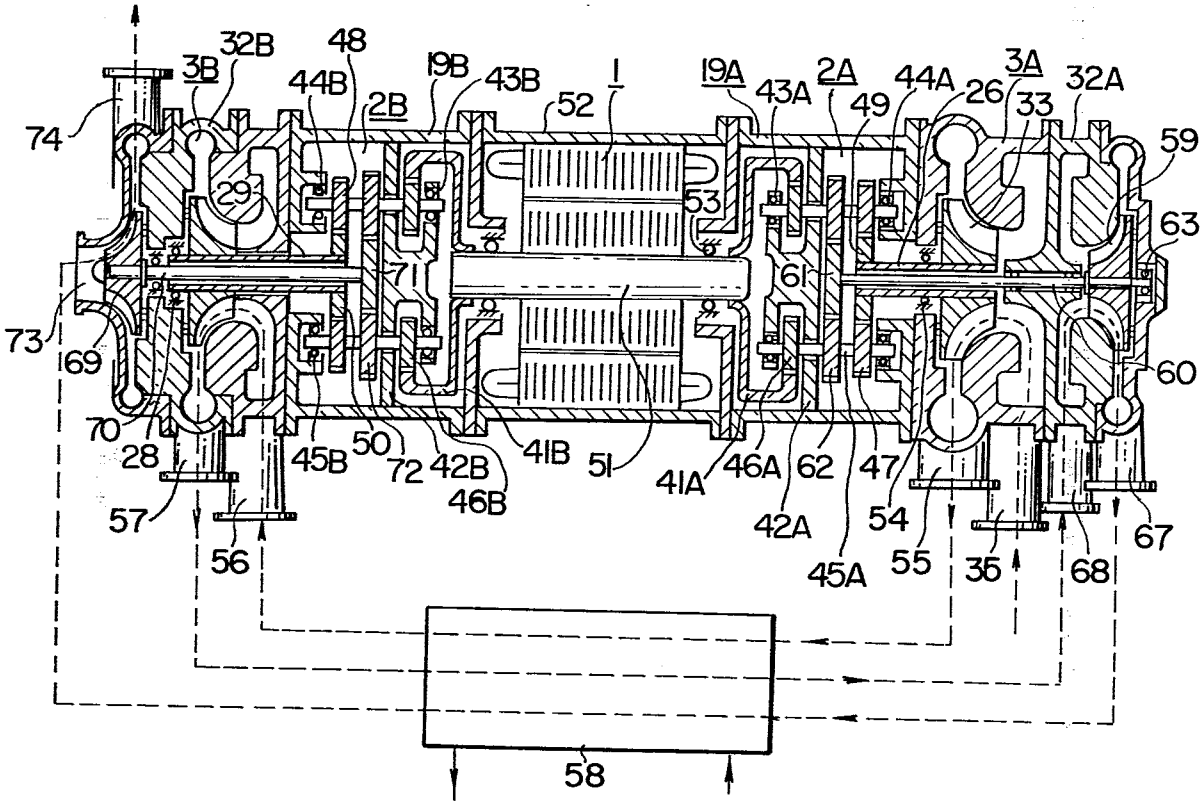

FIG. 9 shows the embodiment in which the number of the transmission means in FIG. 8 is doubled, and those two transmission means are disposed at both sides of the drive electric-motor 1.

Said embodiment is of an arrangement quite similar to that shown in FIG. 8 except for the transmission means 2, so that description thereof is omitted. The transmission means disposed at both sides have the arrangement identical with each other, which is substantially same as that of the embodiment shown in FIGS. 3 and 4. Accordingly, detailed description thereof is omitted. The followings are the parts listed up.

Firstly, with reference to the transmission means 2A at the right side, 19A represents a casing, 26 a hollow rotary shaft, 41A an internal gear, 42A a support, 43A (43A*a*, 43A*b* and 43A*c*) and 44A (44A*a*, 44A*b* and 44A*c*) bearings, 45A (45A*a*, 45A*b* and 45A*c*) shafts, 46A (46A*a*, 46A*b* and 46A*c*) pinions, 47 (47*a*, 47*b* and 47*c*) gears, 49 a first sun gear, 54 (54*a*, 54*b* and 54*c*) bearings, 60 a rotary shaft, 62 (62*a*, 62*b* and 62*c*) gears, and 63 a bearing.

With reference to the transmission means 2B, 19B represents a casing, 28 a bearing, 29 a hollow rotary shaft, 41B an internal gea, 42B a support, 43B (43B*a*, 43B*b* and 43B*c*) and 44B (44B*a*, 44B*b* and 44B*c*) bearings, 45B (45B*a*, 45B*b* and 45B*c*) shafts, 46B (46B*a*, 46B*b* and 46B*c*) pinions, 48 (48*a*, 48*b* and 48*c*) gears, 50 a second sun gear, 70 a rotary shaft, 71 a fourth sun gear, and 72 (72*a*, 72*b* and 72*c*) gears.

Description has been given of the embodiments where the present invention is applied to compressor provided therein with two, three or four impellers, i.e., a plurality of impellers. As described above, said plurality of impellers are disposed in concentric relation with one another and are each secured to an independent shaft. Consequently, the compressors in the above embodiments present such features similar to that of the prior art single-shaft multi-stage compressor that the casing is simplified in construction, and the compressor is rendered compact in size, thus reducing the installation area, and moreover, produce an advantage that the impellers can be each driven at R.P.M. where the highest efficiencies of the respective impellers can be attained in operation or at R.P.M. where the ranges of operation of the respective impellers can be largest.

Figure 10:
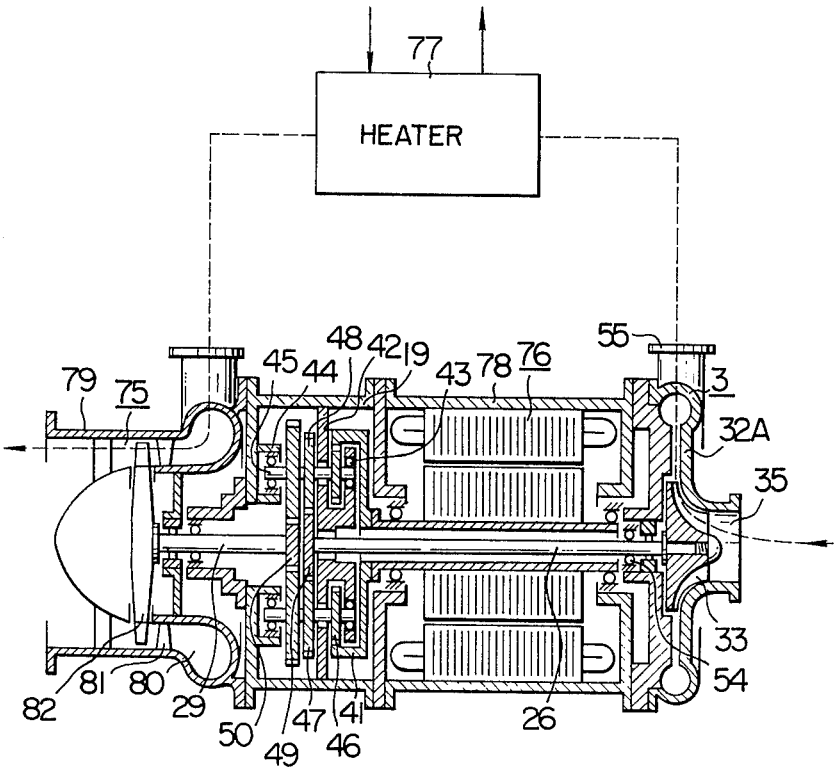

FIG. 10 shows the embodiment in which the present invention is applied to a generator set.

Said embodiment is of an arrangement similar to that of the embodiment shown in FIG. 5 except that there are provided a turbine 75 in place of the compressor having the second impeller 34 in the same position, a generator 76 in place of the drive electric-motor 1, and a heater 77 (a combustor or the like) in place of the intermediate cooler 58.

The turbine 75 comprises: a casing 79 solidly secured to the end portion of a housing 78 of the generator 76; a gas inflow passage 80 defined by the casing 79; stationary blades 81 mounted in the gas passage of the casing 79; and movable blades 82 disposed at a portion downstream of the stationary blades 81 and mounted on the aforesaid rotary shaft 29.

The generator 76 has an arrangement similar to that in general use, so that description thereof is omitted.

Next, operation of this embodiment will be described.

The internal gear 41 is rotated by the generator 76 used as an electric-motor or an electric-motor-installed separately (not shown) at the time of energizing. The rotation of the internal gear 41 is transmitted to the rotary shaft 26 to rotate the impeller 33 (In the embodiment described above, this is the first impeller, whereas there is only one impeller in this embodiment. Therefore, this impeller is simply referred to as "the impeller".), by way of the pinions 46 (46*a*, 46*b* and 46*c*) meshing with the internal gear 41, the shafts 45 (45*a*, 45*b* and 45*c*) to which the pinions 46 (46*a*, 46*b* and 46*c*) are couplingly secured, the gears 47 (47*a*, 47*b* and 47*c*) couplingly secured to the shafts 45 (45*a*, 45*b* and 45*c*) and the first sun gear 49 meshing with the gears 47 (47*a*, 47*b* and 47*c*). The generator 76 is adapted to be used as a generator only when the predetermined R.P.M. is obtained. The rotation of the impeller 33 causes gas to be sucked in through the intake passage 35, compressed and then discharged through the discharge passage 55. The gas thus compressed is heated and given energy in the heater 77, and then supplied to the turbine 75 through the inflow passage 80. Then the movable blades 82 are rotated. This rotation is transmitted to the generator 76 to rotate the rotary shaft thereof for generating electricity, by way of the rotary shaft 29, the second sun gear 50, the gears 48 (48*a*, 48*b* and 48*c*), the shafts 45 (45*a*, 45*b* and 45*c*), the pinions 46 (46*a*, 46*b* and 46*c*), and the internal gear 41. On the other hand, part of the rotating power obtained by the turbine 75 is transmitted to the rotary shaft 26 to rotate the impeller 33, by way of the shafts 45 (45*a*, 45*b* and 45*c*), gears 47 (47*a*, 47*b* and 47*c*) and the first sun gear 49.

As has been described above, the rotary shaft rotating the compressor and the rotary shaft supporting the movable blades of the turbine are separately provided in concentric relation with each other, and said shafts are connected to each other by means of the transmission means, and hence R.P.M. of the impeller of the compressor and R.P.M. of the movable blades of the turbine may be individually selected so that said impeller and said movable blades can operate to obtain the most satisfactory results hydrodynamically. Therefore, such advantages are presented that a generator set of excellent performance and having a large operating range can be provided.

Figure 11:
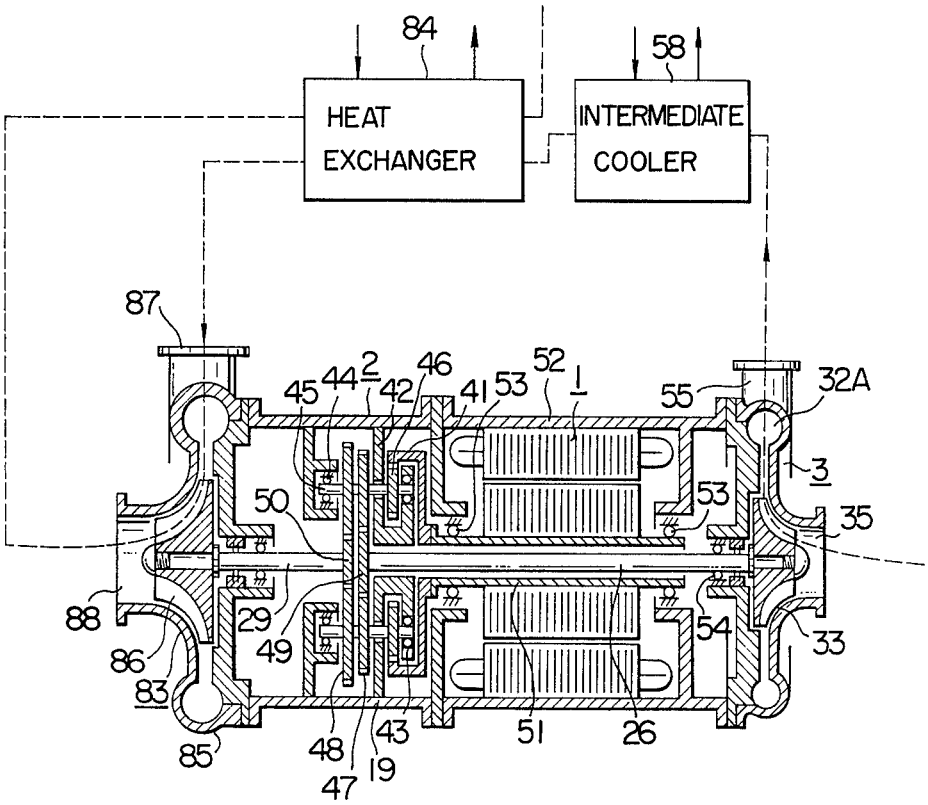

FIG. 11 shows the embodiment in which the present invention is applied to a turbo-desiccator.

Said embodiment is of an arrangement similar to that of the embodiment shown in FIG. 5 except that an expansion turbine 83 is provided in place of the compressor having the second impeller 34 in the same position and a heat exchanger 84 is newly provided between the intermediate cooler 58 and said expansion turbine 83.

The expansion turbine 83 comprises: a casing 85 solidly secured to the casing 19 of the transmission means 2; a turbine impeller 86 solidly secured to the rotary shaft 29; a spiral gas inflow passage 87 defined by the casing 85; and a gas outflow passage 88.

Next, operation of this embodiment will be described.

When the drive electric-motor 1 is energized, the rotation thereof is transmitted to the rotary shaft 26 to rotate the impeller 33, by way of the rotary shaft 51, the internal gear 41, the pinions 46 (46*a*, 46*b* and 46*c*), the shafts 45 (45*a*, 45*b* and 45*c*), the gears 47 (47*a*, 47*b* and 47*c*), and the first sun gear 49. The rotation of the impeller 33 causes a highly humid gas to be sucked in through the intake passage 35, compressed, and then discharged through the discharge passage 55. The gas thus compressed is introduced into the intermediate cooler 58 where the gas is cooled by cooling water and part of the gas is dried, then is led into the heat exchanger 84 where the gas undergoes heat exchange with cold gas introduced from the gas outflow passage 88 of the expansion turbine 83 into the heat exchanger 84 and cooling water to be further cooled and dried, and introduced into the gas inflow passage 87 of the expansion turbine 83. The gas having flowed into the expansion turbine 83 is expanded and lowered in its temperature thereof while rotating the turbine impeller 86 in the turbine, and then is introduced into the heat exchanger 84. The rotation of the turbine impeller 86 is transmitted to the shafts 45 (45*a*, 45*b* and 45*c*) to be used as part of rotating power for rotating the first impeller 33, by way of the rotary shaft 29, the second sun gear 50, and the gears 48 (48*a*, 48*b* and 48*c*).

Although description has been given of the desiccating machine in this embodiment, the low temperature gas discharged from the outflow passage 88 of the expansion turbine can be utilized for air-cooling, namely, said gas can be also utilized for refrigeratory purpose.

As described above, the impeller of the compressor and the impeller of the expansion turbine can be mounted on the separate shafts disposed in concentric relation with each other, and said separate shafts are connected to each other by means of the transmission means, and hence both impellers can be rotated at optimum R.P.M., respectively. Consequently, the desiccating machine or refrigerator having excellent performance and a large range of operation can be obtained.

To summarize the embodiments described above, there can be obtained the fluid rotary machines including a turbo-compressor, turbo-generator, turbo-desiccator, turbo-refrigerator and the like, which are compact in size, requiring small installation areas and yet have excellent performance.

What is claimed is:

1. A fluid rotary machine comprising:

a rotor electrical device including a main shaft rotatable about a main axis, fluid means including a plurality of impellers and casing means enclosing said impellers and defining passages for fluid to be sucked into and discharged from said impellers, said impellers having respective impeller rotational axes aligned with said main axis, and transmission means for operatively drivingly connecting said main shaft with said impellers, said transmission means including a plurality of output shafts which rigidly support respective ones of said impellers for rotation therewith and a gear train for gearingly connecting the main shaft with said output shafts to rotate said output shafts at respective predetermined rotational speeds as compared to the rotational speed of said main shaft, said output shafts having rotational axes aligned with said main axis, said gear train including an output shaft gear mounted rigidly on each of said output shafts at an end thereof for rotation therewith and at least three support gears meshed with and supporting said respective output shaft gears to thereby rotatably support said end of said respective output shafts by said support gears without the interposition of bearing means, wherein at least one of said impellers is disposed at each side of said rotary electric device.

2. A fluid rotary machine according to claim 1, wherein said rotary electrical device is a drive electric motor.

3. A fluid rotary machine according to claim 1, wherein said rotary electrical device is an electric generator.

4. A fluid rotary machine according to claim 2, wherein said transmission means is disposed on one side of said drive electric motor.

5. A fluid rotary machine according to claim 2, wherein said transmission means is disposed on both sides of said drive electric motor.

6. A fluid rotary machine according to claim 2, wherein all of the impellers of said fluid means have the compression action.

7. A fluid rotary machine according to claim 3, wherein some of the impellers of the fluid means have the compression action and the remaining impellers have the expansion action.

8. A fluid rotary machine according to claim 2, further comprising heat exchanger means provided in a fluid passage connecting the impeller of one stage of the fluid means to the impeller of the following stage.

9. A fluid rotary machine according to claim 4, further comprising heat exchanger means provided in a fluid passage connecting the impeller of one stage of the fluid means to the impeller of the following stage.

10. A fluid rotary machine according to claim 5, further comprising heat exchanger means provided in a fluid passage connecting the impeller of one stage of the fluid means to the impeller of the following stage.

11. A fluid rotary machine according to claim 8, wherein said heat exchanger means is a cooler.

12. A fluid rotary machine according to claim 9, wherein said heat exchanger means is a cooler.

13. A fluid rotary machine according to claim 10, wherein said heat exchanger means is a cooler.

14. A fluid rotary machine according to claim 7, wherein said heat exchanger means is a heater.

15. A fluid rotary machine according to claim 2, wherein some of the impellers of the fluid means have the compression action and the remaining impellers have the expansion action.

16. A fluid rotary machine according to claim 2, wherein two of said impellers are provided, wherein said transmission means is disposed at one side of said drive electric motor with the output shaft of the impeller located at the side of the drive electric motor opposite the transmission means extending through said main shaft.

17. A fluid rotary machine according to claim 1, wherein at least one of said impellers is disposed at each side of the transmission means.

18. A fluid rotary machine according to claim 1, wherein a total of three impellers are provided, two of said impellers being at one axial end of said transmission means and the other of said impellers being at the other axial end of said transmission means.

19. A fluid rotary machine according to claim 1, wherein a total of four impellers are provided, two of said impellers being at one axial end of said transmission means and the other two of said impellers being at the other axial end of said transmission means.

20. A fluid rotary machine according to claim 15, further comprising a cooler provided in a fluid passage connecting the impeller having the compression action to the impeller having the expansion action.

21. A fluid rotary machine according to claim 1, wherein said transmission means are provided on both sides of said rotary electrical device and wherein two impellers are connected to each of said transmission means.

* * * * *